US005410977A

United States Patent [19]

Webb

[11] Patent Number: 5,410,977

[45] Date of Patent: May 2, 1995

[54] RUDDERLESS SAILBOAT

[76] Inventor: William B. Webb, 313 Park St., Lake City, Minn. 55041

[21] Appl. No.: 225,466

[22] Filed: Apr. 8, 1994

[51] Int. Cl.[6] ..... B63B 15/00

[52] U.S. Cl. ..... 114/91; 114/61

[58] Field of Search ..... 114/39.1, 61, 345, 89, 114/90, 91, 130, 132; 441/74

[56] References Cited

U.S. PATENT DOCUMENTS

| | | | |
|---|---|---|---|
| 3,972,300 | 8/1976 | Adamski | 114/91 |
| 3,986,473 | 10/1976 | Truzzi | 114/39.1 |
| 4,102,287 | 7/1978 | Ferris | 114/91 |

FOREIGN PATENT DOCUMENTS

| | | | |
|---|---|---|---|
| 2742989 | 4/1979 | Germany | 441/74 |
| 3830820 | 3/1990 | Germany | 114/91 |

*Primary Examiner*—Edwin L. Swinehart

*Attorney, Agent, or Firm*—Haugen and Nikolai

[57] ABSTRACT

A rudderless sailboat having a mast keel assembly which can be pivoted fore or aft to generate a moment of force to effect easy precise sailboat steering. In one embodiment including a catamaran, the keel is integral to the mast and thus pivots correspondingly but in an opposite direction from vertical as the mast is pivoted fore or aft. In yet another embodiment, a monohull is provided wherein a frame extends laterally over each side rail of the hull and downwardly to a respective keel, wherein the mast extends upwardly therefrom. The frame is secured in an oar lock on each side rail. Thus, as the sail and mast is pivoted forwardly, each keel disposed lateral of the side rails is pivoted rearwardly. In still yet another embodiment, a slope-rigged sailboat is disclosed wherein the mast can be pivoted fore or aft by adjusting the length of the forestay and backstay. The keel is stationary, and a winch is used to adjust and secure the position of the mast.

12 Claims, 5 Drawing Sheets

10
20
32
26
14
24
C.E.
30
32
19
12
21
18
P
17
16
15
12
18
22
C.L.R.

10
20
32
26
24
C.E.
14
30
32
21
19
12
18
P
17
16
15
22
12
18
C.L.R.

10
18
F1
12
16
42
M1=0
T1
A1
A2
40
22
WIND
R

10
M1
F1
18
16
12
46
A1
T1
A2
L1
44
22
WIND
R 10
18
F1
M1
12
16
L1
A1
T1
50
A2
48
22
WIND
R

RUDDERLESS SAILBOAT

BACKGROUND OF THE INVENTION

1. Field of the Invention

This invention relates to a sailing craft, and particularly to a sailing craft without a rudder which can be effectively steered.

2. Description of the Prior Art

A variety of sailboats are commercially available which can be used for recreation or competition. These sailboats can have a monohull, or multihulls, depending on the intended use. Sailboats used for competition are uniquely designed to have a minimal hydrodynamic and aerodynamic drag, a large and controllable sail surface area, and include a variety of novel control features to provide a responsive and agile craft.

Hydrodynamic drag comprises the greatest component of resistance to a sailboats' forward progress. All portions of the sailboat interfacing with the water, including the hull, keel and rudder create hydrodynamic drag. Thus, particular attention to the design of these components is provided for a sailboat. Conventionally, a rudder is implemented to help steer the sailboat, and usually resides at the stern of the hull(s). To decrease hydrodynamic drag, it is desirable to eliminate the need for a rudder while still retaining adequate control of the sailboat.

Steering a sailboat without the aid of a rudder is not a new concept. For instance, a sailboard is a popular water craft sold today which comprises a mast pivotably coupled via a ball-in-socket joint to and extending upwardly from a sailboard. Steering is accomplished by tilting the mast (with sail) fore and aft.

In U.S. Pat. No. 4,819,574, a rudderless sailboat is taught including a pair of fixed masts, and a pair of sails of approximately equal surface area, one disposed each side of the keel. The craft is steered by controlling both sails simultaneously from the cockpit area. A mechanism is used consisting of either a single rope rigged to both sails, or a steering wheel and gearbox with chain-drives, to rotate the booms at the base of each sail. To achieve steering, a mechanism differentially alters the trim angle of the two sails to cause the aeroforce exerted by the wind to increase on one sail, and to decrease the force on the other sail. In this embodiment, the keel is disposed between the sails and is fixed in relation to the hull.

OBJECTS

It is accordingly a principle object of the present invention to provide a rudderless sailboat with a reduced hydrodynamic drag.

Still yet a further object of the present invention is to provide a rudderless sailboat which can be easily and precisionally steered.

Still yet a further object of the present invention is to provide a rudderless sailboat concept which can be implemented with a variety of hulls, including monohulls and multiple hulls.

Still yet a further object of the present invention is to provide a sail and mast assembly which can be adapted to a monohull boat, such as a typical inflatable dingy comprising a pair of inflatable pontoons, to create a sailboat.

Other objects, features and advantages of the present invention will become apparent to those skilled in the art through the Description of the Preferred Embodiment, Claims, and drawings herein wherein like numerals refer to like elements.

SUMMARY OF THE INVENTION

The foregoing objects and advantages of the present invention are achieved by providing a rudderless sailboat having a mast (with sail) and keel assembly selectively pivotable either fore or aft to control steering of the sailboat.

In one embodiment, a pair of hulls are provided with an integral mast and keel vertically extending therebetween, and pivotable fore or aft. A lateral frame member extends to each side from between the foot of the sail and the keel, and is pivotably attached to each respective hull. To steer the craft to starboard, with the wind originating from port, this mast and sail assembly is pivoted forwardly such that the keel correspondingly is pivoted rearwardly. A moment is provided about the forward mast and rearward keel to steer the hulls to starboard. Conversely, to steer the craft to port with the wind originating from port, the sail and mast assembly are pivoted rearwardly such that the keel correspondingly is pivoted forwardly. A moment is provided about the rearward mast and the forward keel to steer the hulls to port.

In yet another embodiment of the present invention, a monohull boat convertible into a sailboat is disclosed. The hull has a pair of side rails, such as an inflatable dingy having inflatable pontoons longitudinally extending each side thereof. A mast is provided extending upwardly from between the side rails. A frame at the base of the mast provides lateral support of the mast. The frame further comprises a member extending laterally each side thereof, over the side rails and then downwardly towards the water. A keel is securingly attached to the distal end of each side of the frame and extends downwardly into the water. The frame is secured to the top of the side rails by a locking member, such as a oar lock, such that the frame and mast cannot shift relative to the side rails.

To steer this sailboat with the wind coming from port, the mast is tilted forwardly towards the bow of the boat. The keels disposed to each side of the side rails are consequently pivoted rearwardly. The vessel will be steered to starboard since a moment will be created about the forward mast and rearward keels. Conversely, where the wind is coming from starboard, the vessel will be steered to port. To steer the craft in the opposite direction just described, the mast is tilted rearwardly such that the keels disposed each side of the hull are correspondingly rotated forwardly.

DESCRIPTION OF THE PREFERRED EMBODIMENT

Figure 1:
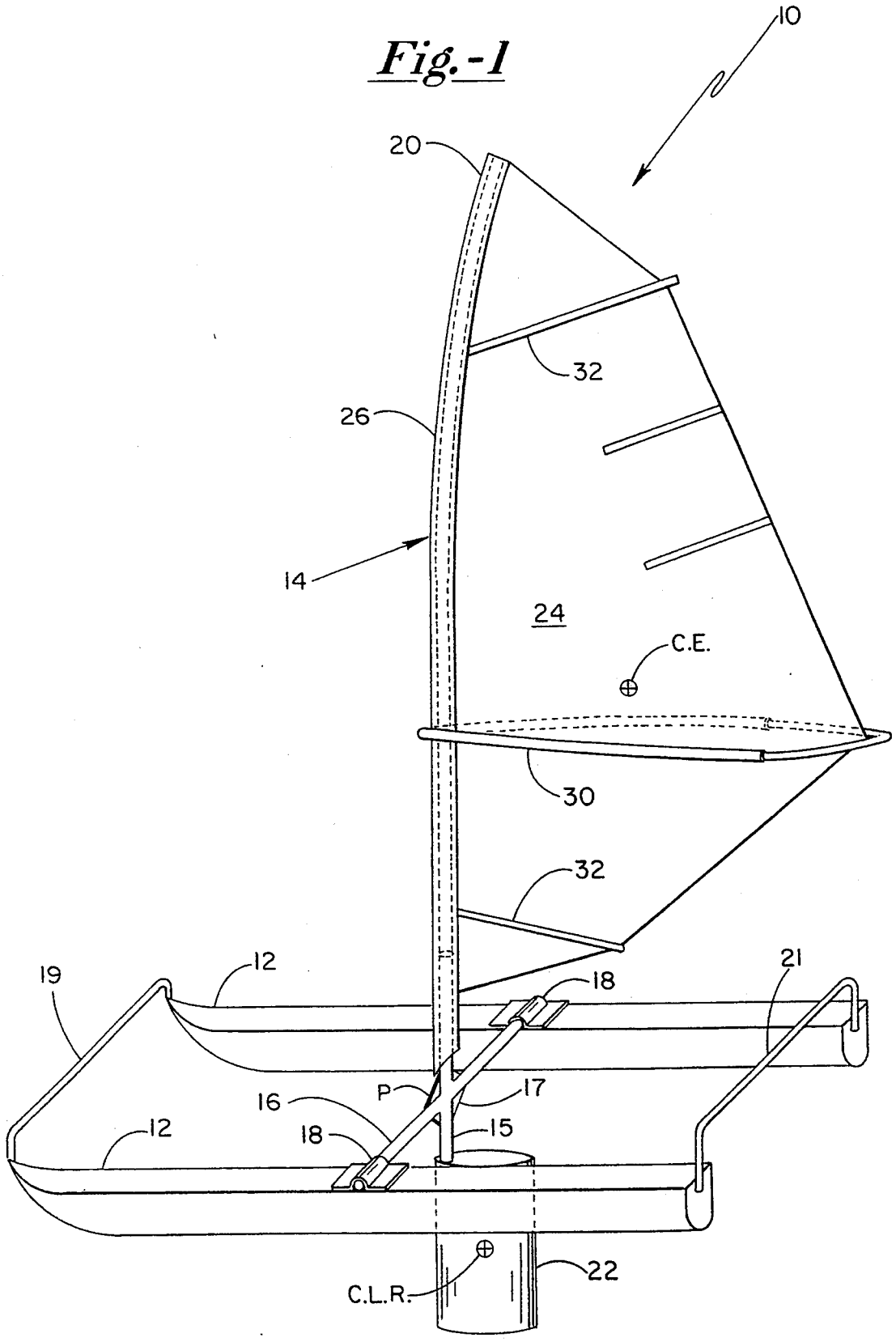
FIG. 1 is a perspective view of a twin hull or catamaran style sailboat wherein the mast extends upwardly from an integral keel, and which is pivotable fore or aft between the hulls halfway therebetween.

Referring to FIG. 1, a rudderless catamaran sailboat is shown generally at 10. Sailboat 10 includes a pair of parallel floatation pontoons 12, and a rigid inflatable mast 14 extending upwardly between the pontoons 12. A rigid mast support 15 includes a pair of opposing rigid frame members 16 rotatably coupled to each pontoon 12. Each member 16 laterally extends from the lower portion of mast support 15 and is secured thereto such as by welding, and includes a gusset 17 providing strength. The opposing distal ends of each frame member 16 are pivotably and rotatably coupled to the upper midsection of the respective pontoon 12. The distal ends are axially disposed through a respective curved bracket 18 secured to the upper surface of the respective pontoon 12, as shown. The distal end of each frame member 16 is restricted from lateral shifting within the respective bracket 18 by a pair of large keeper pins, one pin being disposed through the respective frame member 16 each side of bracket 18. A front tie 19 and a rear tie 21 extend between and are secured to each pontoon 12 to provide torsional strength.

Mast member 14 extends between an upper end 20 and a lower end defined proximate members 16, which lower end terminates at and is secured to a keel 22. When mast 14 is pivoted forwardly, frame members 16 each rotate within respective bracket 18, and the mast upper end 20 and keel 22 correspondingly rotate about pivot point P. (See FIG. 2). A sail 24 is secured to a vertically extending flexible mast sleeve 26 along the forward edge of sail 24, as shown. Sleeve 26 is generally tubular being sewn into and consisting of sail cloth, and is selectively disposed over mast support 15 in a friction fit. A sail boom 30 extends rearward on each side of sail 24 along the major surfaces thereof. A plurality of rigid reinforcing members 32 are provided along the rear edges of sail 24, each extending inwardly towards mast 14, as shown, to reinforce sail 24 and along with boom 30, to maintain an open sail surface.

Figure 2:
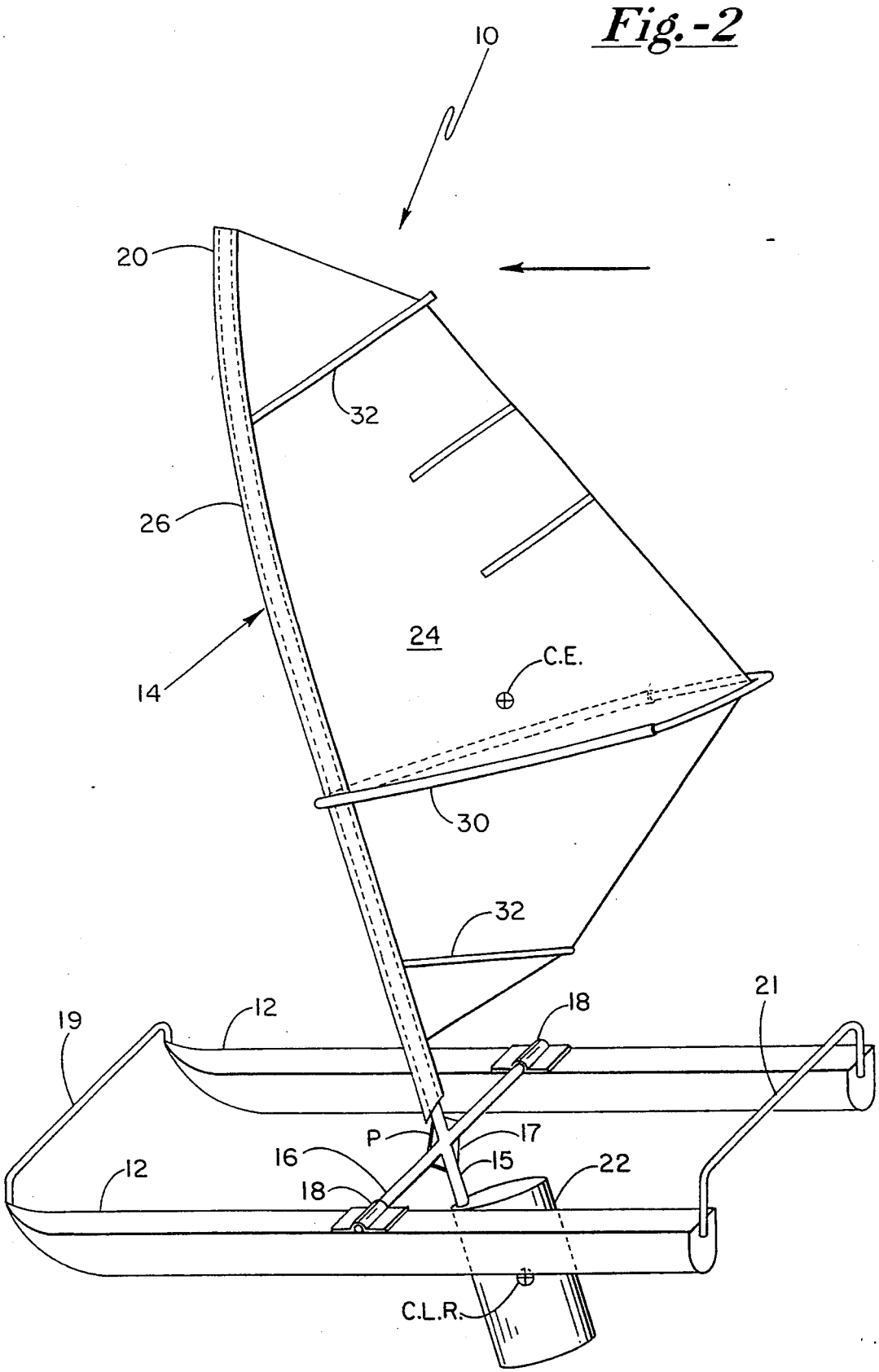
FIG. 2 is a perspective view of the catamaran sailboat shown in FIG. 1 illustrating the mast and sail assembly pivoted forwardly with the keel correspondingly rotated rearwardly.
Figure 3:
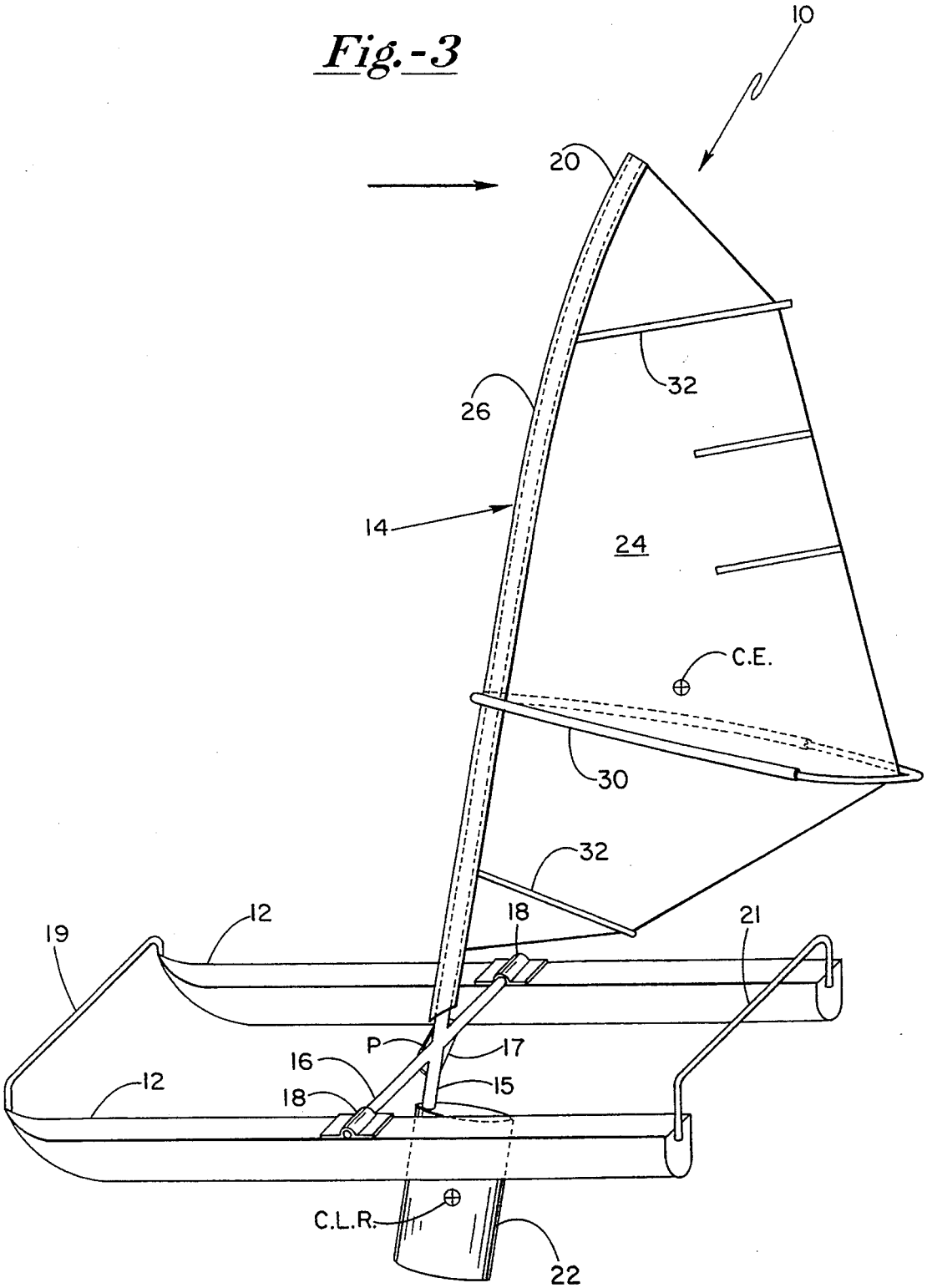
FIG. 3 is a perspective view of the catamaran sailboat shown in FIG. 1 with the mast and sail assembly rotated rearwardly with the keel correspondingly rotated forwardly.
Figure 4A:
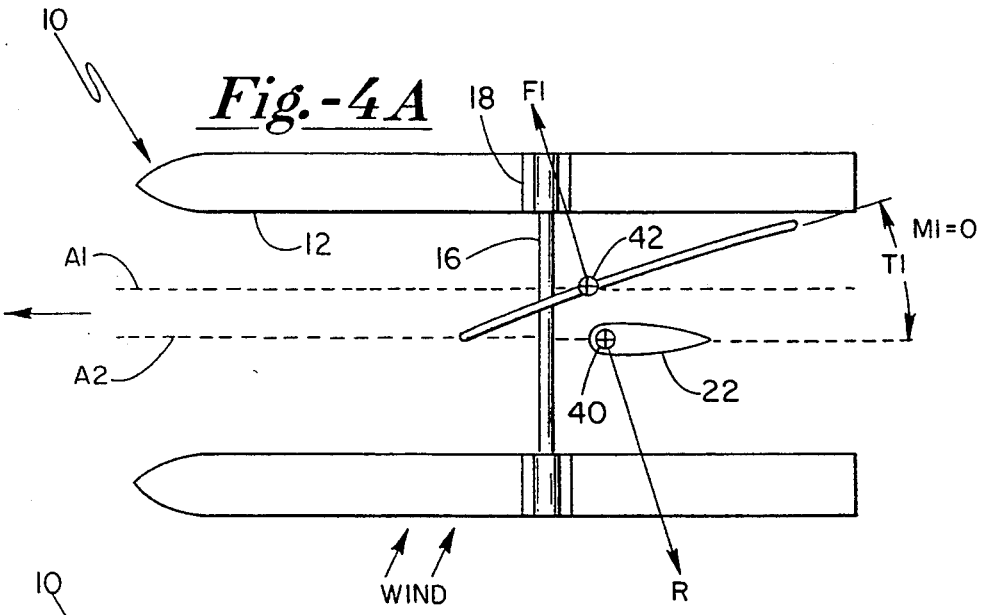
FIG. 4A is a plan view of the sailboat in FIG. 1 with the mast and sail tilted slightly forward of vertical illustrating the geometric relationship between the sail and keel, wherein the hydrodynamic and aerodynamic forces result in no turning moment M1.
Figure 4B:
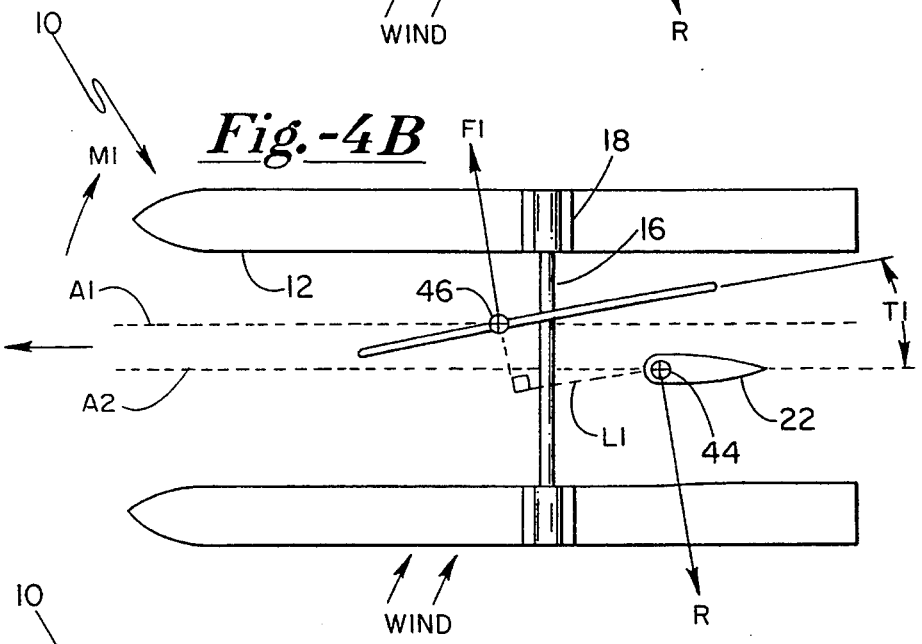
FIG. 4B is a plan view of the sailboat in FIG. 1 showing the sail and mast tilted forwardly and the keel rearwardly for producing a clockwise turning moment M1 on the sailboat.
Figure 4C:
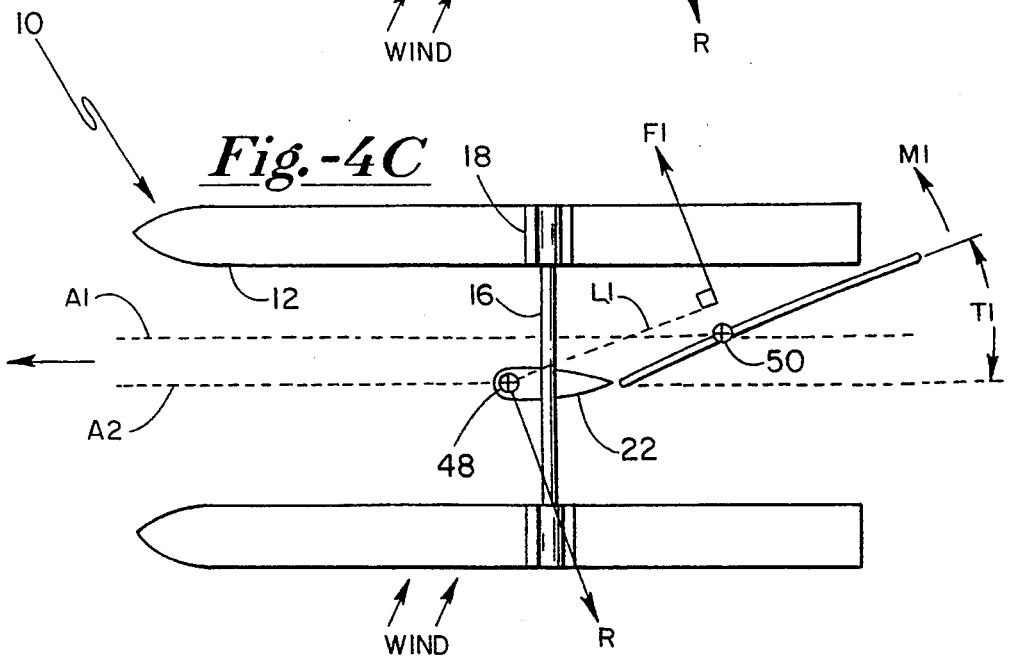
FIG. 4C is a plan view of the sailboat in FIG. 1 showing the sail and mast tilted rearwardly for producing a counterclockwise turning moment M1 about the keel.

Referring now to FIGS. 1–3 in view of plan FIGS. 4A, 4B and 4C, the operational features of this novel rudderless sailboat can be appreciated. By way of demonstration, if it is assumed the wind is blowing from port and thus impinging upon the surface of sail 24 as shown in FIGS. 4A, 4B and 4C, one can steer sailboat 10 by motioning mast upper end 20 and sail 24 forwardly or rearwardly, along a center axis A2 between the pontoons, such that keel 22 correspondingly rotates in the opposite direction and about pivot point P.

First, referring to FIG. 4A, if sail 24 and mast upper end 20 is tilted slightly forward from that shown in FIG. 1, and keel 22 thus tilted slightly aft, the sailboat will be steered straight forward. The hydrodynamic center of force R extending from the center of lateral resistance (C.L.R.) of keel 22 is generally shown at 40. The aerodynamic center of force F1 is generally shown at 42 and extends from the sail center of effort (C.E.). These forces are equal and opposite and occur in the same vertical plane so no moment of force M1 is generated, and thus, sailboat 10 steers forwardly without turning.

In reference to FIGS. 2 and 4B, if sail 24 and mast upper end 20 are pivoted further forwardly, wherein keel 22 pivots rearwardly, as shown, the hydrodynamic center of force R extending from the C.L.R. is shifted rearwardly along line A2 to position 44. The aerodynamic center of force F1 is correspondingly shifted forwardly along line A1 to position 46. The force couple now acts on lever arm L1. Lever arm L1 is the perpendicular distance between the line of action of aerodynamic force F1 and the C.L.R. of keel 22. Thus, a clockwise moment of force M1 is developed such that the sailboat will steer to starboard. (The bow of the sailboat is said to fall-off-the-wind.)

Conversely, as shown in FIG. 3 and 4C, if sail 24 is pivoted rearwardly such that keel 22 is pivoted forwardly, the hydrodynamic center of force R is shifted forwardly along line A2 to position 48, and the aerodynamic center of force F1 is shifted rearwardly along line A1 to 50. Hence, a counterclockwise moment of force M1 is generated such that sailboat 10 steers to the port. (The bow of the sailboat is said to come-up-into-the-wind.)

If the wind is assumed to come from starboard rather than port and impinge upon the other side of sail 24 shown in FIG. 1, tilting the mast 20 forward with corresponding tilt rearward of the keel 22 will cause the sailboat to steer to port and the bow of the boat will be said to fall-off-the-wind. Tilting the mast 20 rearward with corresponding tilt forward of the keel 22 will cause the sailboat to steer to starboard and the bow of the boat will be said to come-up-into-the-wind.

In summary, at slight tilt forward of mast 20, an equilibrium of sail and keel forces can be found which cause straight forward steering. Greater tilts forward cause the bow of the sailboat to fall-off-the-wind. Greater tilts of mast 20 rearward cause the bow of the boat to come-up-into-the-wind.

The further mast 20 is tilted forward with corresponding tilt rearward of the keel 22, the greater the lever arm L1 and the greater the moment M1 causing the bow of the boat to fall-off-the-wind. The further mast 20 is tilted rearward with corresponding forward tilt of the keel 22, the greater the lever arm L1 and greater the moment M1 causing the bow of the boat to come-up-into-the-wind.

Very large and effective steering moments result from large angles of tilt, resulting in easy and precise steering.

The angle of sail 24 is shown as trim angle T1. This trim angle T1 can be adjusted by rotating sail 24 and sleeve 26 about mast 20 to cause sail 24 to achieve optimum aerodynamic angles of attack relative to the wind.

The total sail area of the sail 24 in the sailboat at 10 will generally be ten square meters or less. Forces generated by this size sail can generally be manually restrained by one or two crew of the sailboat. It is thus intended that tilt of the mast/keel steering system and setting of the sail trim angle can be accomplished manually by crew setting and/or standing on the structure of the sailboat. Lines with block and tackle from the sail boom 30 to the stern of the boat may be employed to relieve some sail forces generated when sailing in excessively heavy winds.

Figure 5:
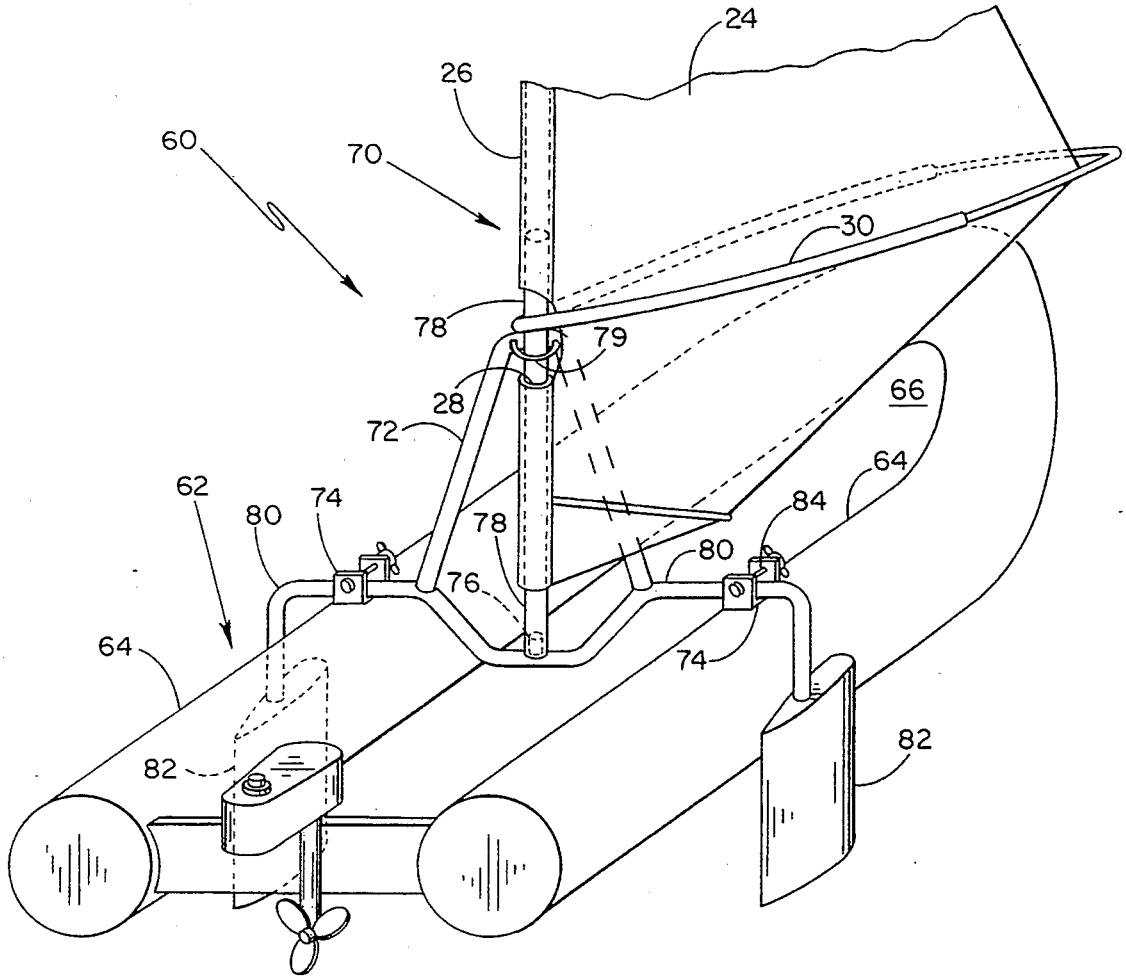
FIG. 5 is an alternative preferred embodiment of the present invention illustrating a monohull craft converted to a sailboat, wherein a mast with a pivotable frame assembly is provided laterally extending between the oar locks and then downwardly to a respective keel.

Referring now to FIG. 5 an alternative preferred embodiment of the invention is shown at 60. Sail craft 60 incorporates the principles of the preferred embodiment of the invention and is comprised of a monohull craft converted to a sailboat. More specifically, inflatable monohull 62, such as an inflatable powered dingy, including a pair of inflated side rails 64 and an inflated bottom 66 can be converted to a sailboat by adapting a sail assembly 70 to monohull 62 as shown.

In this embodiment, sail assembly 70 having a generally triangular frame portion 72 is adapted to monohull 62, and into a pair of oar locks 74, such that frame assembly 72 cannot shift longitudinally along the tops of inflated sidewalls 64. Frame assembly 72 includes a cylindrical stub portion 76 extending upwardly at a center portion thereof for rotatably receiving a tubular mast 78 in a sleeve-like arrangement as shown. Accordingly, mast 78 can pivot axially about stub 76 to trim the angle of the sail. Sail assembly 70 includes sail 24 as previously discussed in regards to FIG. 1.

Frame assembly 72 is further characterized as having a pair of opposing laterally extending frame portions 80. Each portion 80 extends laterally through respective oar locks 74, beyond the sides of inflated side walls 64, and then extend downwardly and terminates at a respective keel 82. A U-bracket 79 is secured to the top of triangular shaped frame member 72, as shown, and rotatably receives and constrains upwardly extending mast 78, this upper portion being exposed by an opening 81 defined in sleeve 26 for axial rotation therewithin. Each oar lock 74 is provided with a cotter pin and bolt assembly 84 for restraining each laterally extending frame member 80 therewithin while allowing pivoting rotation therewithin as described, yet which prevents longitudinal shifting of sail assembly 70 along side rails 64.

In use, the lower curved portion of frame assembly 72 resides along boat bottom 66 with mast 78 extending upwardly therefrom. To affect steering of sailboat 60, a crew tilts mast 78, and thus sail 24, forwardly such that each side keel 82 is correspondingly tilted rearwardly.

The same principles of steering sailboat 10 in FIG. 1 apply to steering the sailboat 60 in FIG. 5. The schematic illustrations of FIGS. 4A, 4B and 4C equally apply to this embodiment for generating a steering moment M1 from aerodynamic and hydrodynamic forces.

While an inflatable dingy is shown in FIG. 5, it is also to be recognized that other monohulls, such as small fishing boats or the like, can be implemented as well according to the alternative preferred embodiment discussed in regards to FIG. 5.

This invention has been described herein in considerable detail in order to comply with the Patent Statutes and to provide those skilled in the art with the information needed to apply the novel principles and to construct and use such specialized components as are required. However, it is to be understood that the invention can be carried out by specifically different equipment and devices, and that various modifications, both as to the equipment details and operating procedures, can be accomplished without departing from the scope of the invention itself. For instance, it is to be recognized that a keel can be coupled to a pivoting mast through a gearing arrangement such that the keel pivots proportionally with the mast during rotation, but not necessarily at a correspondingly 1:1 relationship. Any sailboat implementing a mast and keel which can be selectively pivoted fore or aft to create a moment of force to steer the sailboat, is contemplated by the present invention.

I claim:

1. A sailboat, comprising:

(a) hull means having a bow and a stern;

(b) an upwardly extending mast means having an upper end and a lower end, said lower end adjustably coupled to said hull means at a pivot point such that said mast means can rotate fore or aft toward said bow and said stern, respectively;

(c) a sail coupled to said mast means;

(d) keel means coupled to said mast lower end and rotatable either fore and aft as said mast means is rotated about said pivot point; and (e) said mast means including a pair of opposing members each extending laterally from a lower midsection of said mast means to a respective distal end, each said member distal end being coupled to and adjustably positionable with respect to said hull means.

2. The sailboat as specified in claim 1 wherein said hull means comprises a pair of longitudinally extending hulls, wherein each said member distal end is adjustably coupled to one said hull such that said mast means extends upwardly from between said hulls.

3. The sailboat as specified in claim 1 wherein said mast means further includes a laterally extending boom.

4. The sailboat as specified in claim 1 wherein said keel means is securingly coupled to said mast means such that rotation of said mast means creates corresponding rotation of both said mast means and said keel means about said pivot point.

5. The sailboat as specified in claim 1 wherein said mast means is rotatably coupled to said hull means such that said mast means is rotatably fore and aft only.

6. The sailboat as specified in claim 1 wherein said hull means is comprised of an inflatable hull.

7. The sailboat as specified in claim 1 wherein said mast means is rigid.

8. A sailboat, comprising:

(a) hull means having a bow and a stern;

(b) an upwardly extending mast means having an upper end and a lower end, said lower end adjustably coupled to said hull means at a pivot point such that said mast means can rotate fore or aft toward said bow and said stern, respectively;

(c) a sail coupled to said mast means;

(d) keel means coupled to said mast lower end and rotatable either fore and aft as said mast means is rotated about said pivot point;

(e) said hull means comprises a monohull; and (f) said monohull has a pair of opposing side rails, and said mast means includes a frame means laterally extending over each opposing said side rail to a respective distal end, wherein said keel means comprises a pair of keels, one coupled to each said frame means distal end and extending downwardly.

9. The sailboat as specified in claim 8 wherein said monohull side rails each include a restraining means for restricting shifting of said frame means along said side rails.

10. The sailboat as specified in claim 9 wherein said restraining means comprises oar locks.

11. The sailboat as specified in claim 8 wherein said frame means has a generally triangular shaped portion at a midsection thereof, wherein said mast means includes a mast member extending vertically upward therefrom and adapted to coupled to said sail.

12. The sailboat as specified in claim 11 wherein said frame means further includes a pair of frame members, one said frame member extending laterally from each side of said triangular shaped frame portion and over said monohull side rails.

* * * * *